US010278255B1

(12) United States Patent
Wu et al.

(10) Patent No.: US 10,278,255 B1
(45) Date of Patent: Apr. 30, 2019

(54) LIGHT-EMITTING DEVICE WITH DIGITAL CONTROL OF COLOR TEMPERATURE MODULATION AND APPLICATION THEREOF

(71) Applicant: UNITY OPTO TECHNOLOGY CO., LTD., New Taipei (TW)

(72) Inventors: Chih-Hsien Wu, New Taipei (TW); Wei Chang, New Taipei (TW); Kai-Cheng Chuang, New Taipei (TW); Kuo-Tien Cheng, New Taipei (TW); Hsin-Chieh Liao, New Taipei (TW); Jia-Hao Siao, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 0 days.

(21) Appl. No.: 15/941,539

(22) Filed: Mar. 30, 2018

(30) Foreign Application Priority Data

Feb. 9, 2018 (TW) ..... 107104699 A

(51) Int. Cl.
*H05B 33/08* (2006.01)
*F21Y 115/10* (2016.01)
*F21V 33/00* (2006.01)

(52) U.S. Cl.
CPC ..... *H05B 33/0872* (2013.01); *H05B 33/086* (2013.01); *F21V 33/004* (2013.01); *F21Y 2115/10* (2016.08); *H05B 33/0812* (2013.01)

(58) Field of Classification Search
CPC ..... H05B 33/0872; H05B 33/086; H05B 33/0812; H05B 33/0845; H05B 33/0827; H05B 33/0857; H05B 33/083; F21V 33/004; F21Y 2115/10; H01H 9/16
See application file for complete search history.

(56) References Cited

U.S. PATENT DOCUMENTS

2003/0114256 A1* 6/2003 Mathog ..... A63B 69/0053 473/422
2007/0171649 A1* 7/2007 Rains, Jr. ..... F21S 2/00 362/303

(Continued)

FOREIGN PATENT DOCUMENTS

JP 2012148029 A * 8/2012
TW M469624 U 1/2014
TW M500858 U 5/2015

*Primary Examiner* — Tung X Le
*Assistant Examiner* — Henry Luong
(74) *Attorney, Agent, or Firm* — Rosenberg, Klein & Lee

(57) ABSTRACT

Disclosed are a light-emitting device for digital control of color temperature modulation and its application. The light-emitting device is electrically connected to a wall switch and includes a DIP switch, first LEDs, second LEDs and a control module. The control module is electrically connected to the above components and contains a truth table. The truth table includes at least a first mode, second mode, third mode and a memory and automatically switch mode, and a digital switching is accomplished by correlating the DIP switch to the truth table. In the memory and automatically switch mode, the first to third mode color temperatures are sequentially switched and controlled by turning on or off the wall switch according to the truth table information. The light-emitting device may be applied to light fixtures or mirror products to improve the convenience of use.

18 Claims, 5 Drawing Sheets

(56) References Cited

U.S. PATENT DOCUMENTS

| | | | | |
|---|---|---|---|---|
| 2014/0035475 | A1* | 2/2014 | Suh | H05B 33/0815<br>315/200 R |
| 2016/0302276 | A1* | 10/2016 | Fushimi | H05B 33/0848 |
| 2017/0257916 | A1* | 9/2017 | Sumitani | H05B 37/02 |
| 2017/0339760 | A1* | 11/2017 | Seki | H05B 33/0827 |

* cited by examiner

LIGHT-EMITTING DEVICE WITH DIGITAL CONTROL OF COLOR TEMPERATURE MODULATION AND APPLICATION THEREOF

CROSS-REFERENCE TO RELATED APPLICATIONS

This non-provisional application claims priority under 35 U.S.C. § 119(a) on Patent Application No(s). 107104699 filed in Taiwan, R.O.C. on Feb. 9, 2018, the entire contents of which are hereby incorporated by reference.

FIELD OF INVENTION

The present invention relates to the field of light-emitting diode (LED) devices, in particular to a light-emitting device with digital control of color temperature modulation and its application, and the light-emitting device provides a stable color temperature modulation function through digital control.

BACKGROUND OF INVENTION

1. Description of the Related Art

At present, Light Emitting Diode (LED) featuring low power consumption and excellent light emitting property has become a common product in the market. The expression of color temperature of an LED varies with the light emitting property such as cold blue LED or warm yellow LED, etc.

According to different applications and using requirements, the LED generally comes with an adjustable color temperature, and thus there are various different designs provided for modulating the color temperature of the LED. In the conventional modulation of the color temperature of the LED, analog control is used to modulate the light-emitting color temperature of the LED. In other words, a mechanical switch is provided for switching a circuit contact to another circuit contact in order to control the conductive state of the LEDs of different color temperatures, so that after each LED is serially connected and driven, the LED shows the required color temperature. As to the circuit design for the analog control of the color temperature, the inventor of the present invention has also filed related patent applications as disclosed in R.O.C. Pat. No. M469624 and M500858. In R.O.C. Pat. No. M469624, a switch is provided for adjusting the conductive state of a blue LED string and a yellow LED string to change the color temperature of a lamp. In R.O.C. Pat. No. M500858, a switch is provided for switching the conductive state of an LED string to change the light-emitting color temperature of a lamp.

However, the aforementioned design of using an analog control (which is a mechanical switch) to control the change of color temperature is operated by switching the ON and OFF states by a circuit when switching and driving an LED string, so that an uncertain circuit connection or short circuit may occur easily during the switching operation to affect the effect of controlling the color temperature. The operation of switching to the ON and OFF states repeatedly, the switch and the circuit contact may be worn out easily to give rise to poor contacts and electric arcs and also shorten the service life of the product significantly. On the other hand, LED strings corresponding to their color temperatures are installed one by one to cope with the expression of the required color temperature, and the switching of the switch is used to determine the conductive state of each LED string in order to achieve the effect of showing the required color temperature. As a result, the cost of the product is increased greatly. Therefore, it is a main subject for related designer and manufacturers to modulate the light-emitting color temperature of the LED surely and stably, extend the service life, and lower the cost of the product.

In view of the drawbacks of the aforementioned mechanical control, the inventor of the present invention discloses a light-emitting device with digital control of color temperature modulation and its application to overcome the drawbacks including the inconvenience and low performance of the prior art.

2. Summary of the Invention

Therefore, it is a primary objective of the present invention to provide a light-emitting device with digital control of color temperature modulation and its application that use digital switching and color mixing control to improve the stability of switching the color temperature while extending the life and reducing the setup cost of the product effectively, and the light-emitting device may be used as a light source for various different products to improve the convenience of use of the light-emitting or lighting products.

To achieve the aforementioned and other objectives, the present invention provides an embodiment of a light-emitting device with digital control of color temperature modulation, electrically coupled to a wall switch for controlling an ON or OFF state, comprising: a DIP switch; a plurality of first LEDs, having a first color temperature; a plurality of second LEDs, having a second color temperature; and a control module, electrically coupled to the wall switch, the DIP switch, the first LEDs, and the second LEDs, wherein a truth table information is written into the control module, and the truth table information includes a first mode, a second mode, a third mode, and a memory and automatic switch mode, and digital switching is accomplished by correlating the DIP switch to the truth table information, and only the first LEDs are turned ON under a fixed power in the first mode; both of the first LEDs and the second LEDs are turned ON simultaneously under the fixed power in the second mode; only the second LEDs are turned on under the fixed power in the third mode; and in the memory and automatic switch mode, the color temperature is sequentially switched and controlled by the operation of turning the wall switch on and off and according to the truth table information which is the first mode, the second mode, and the third mode.

The truth table information is combined with the wall switch and the DIP switch for achieving the digital switching, and this method can improve the stability of the color temperature modulation of the light-emitting device and achieve the effects of lowering the setup cost and extending the service life of the product effectively.

In another embodiment, the control module has a delay off mechanism. When the wall switch is turned OFF, the timing asynchronously shows an electrically OFF state, and when the wall switch is turned ON, a power divided voltage is read to detect the number of times of switching, which is provided for the memory and automatic switch mode to be saved as a mode of the previous table information. Therefore, the control module can save the mode of the previous truth table information when the wall switch was operated last time, so as to facilitate the next operation according to the truth table information, and the color temperature of the light-emitting device is sequentially switched and controlled.

In a further embodiment, the light-emitting device further comprises a linear dimming module electrically coupled to the control module and the wall switch for linearly adjusting the output of the fixed power. Therefore, the brightness of the light-emitting device can be changed linearly and adjusted according to user requirements.

In an embodiment, the first color temperature is 3000K, and the second color temperature is 5000K. Preferably, the first LEDs and the second LEDs are arranged alternately, so as to express a color temperature in compliance with most requirements and the overall light output of the light-emitting device is more uniformly.

In an embodiment, the light-emitting device further comprises a sensing module, electrically coupled to the control module for detecting an ambient color temperature, and the light emission ratio and mode of the first LEDs and the second LEDs being adjusted according to the ambient color temperature when the first and second LEDs are situated at the second mode. Therefore, the light-emitting device can be driven automatically to show the corresponding required color temperature of the light-emitting device according to the installation environment of the light-emitting device.

In addition, the present invention also discloses an application of the light-emitting device. In an embodiment, the present invention discloses a light fixture, comprising: a main body, having a mount; and a light-emitting device as described in the aforementioned embodiments, installed to the mount, for providing light. Therefore, the color temperature of the light-emitting device applying the light fixture can be adjusted according to a user's preference, and the switching and expression of different color temperatures can be provided stably by the digital control method.

In another embodiment, the present invention discloses a mirror with a light emitting effect, comprising a mirror body; a fixed frame, for fixing the mirror body; and a light-emitting device as described in the aforementioned embodiments, installed to the fixed frame, for providing light.

The mirror comprises: a mirror body; a fixed frame, for fixing the mirror body; and a light-emitting device as described in the aforementioned embodiments, installed to the fixed frame, for providing light. Therefore, when a user looks at the mirror, the user may modulate the lighting color temperature freely according to requirements, so as to perform a white balance correction, and improve the using performance of the mirror.

In summation of the description above, the light-emitting device with digital control of color temperature modulation and its application in accordance with the invention combines the truth table information with the DIP switch and the wall switch for digital switching and color mixing control to effectively overcome the drawbacks of having a short circuit or disconnection caused by the switch when the color temperature is modulated by the conventional analog control mechanism and a short service life caused by the worn-out of the circuit in a long time of use. Therefore, the invention has the effects of lowering the high cost, providing a stable multi-color temperature expression, reducing the setup cost and extending the service life of the light-emitting device. With the linear dimming module and the sensing module, the performance of the light-emitting device can be improved to meet the output light expression for different requirements. In addition, the light-emitting device may be applied to a light fixture or a mirror to enhance the function of the light fixture or mirror.

DESCRIPTION OF THE PREFERRED EMBODIMENTS

To make it easier for our examiner to understand the objective, technical characteristics, structure, innovative features, and performance of the invention, we use preferred embodiments together with the attached drawings for the detailed description of the invention.

Figure 1:
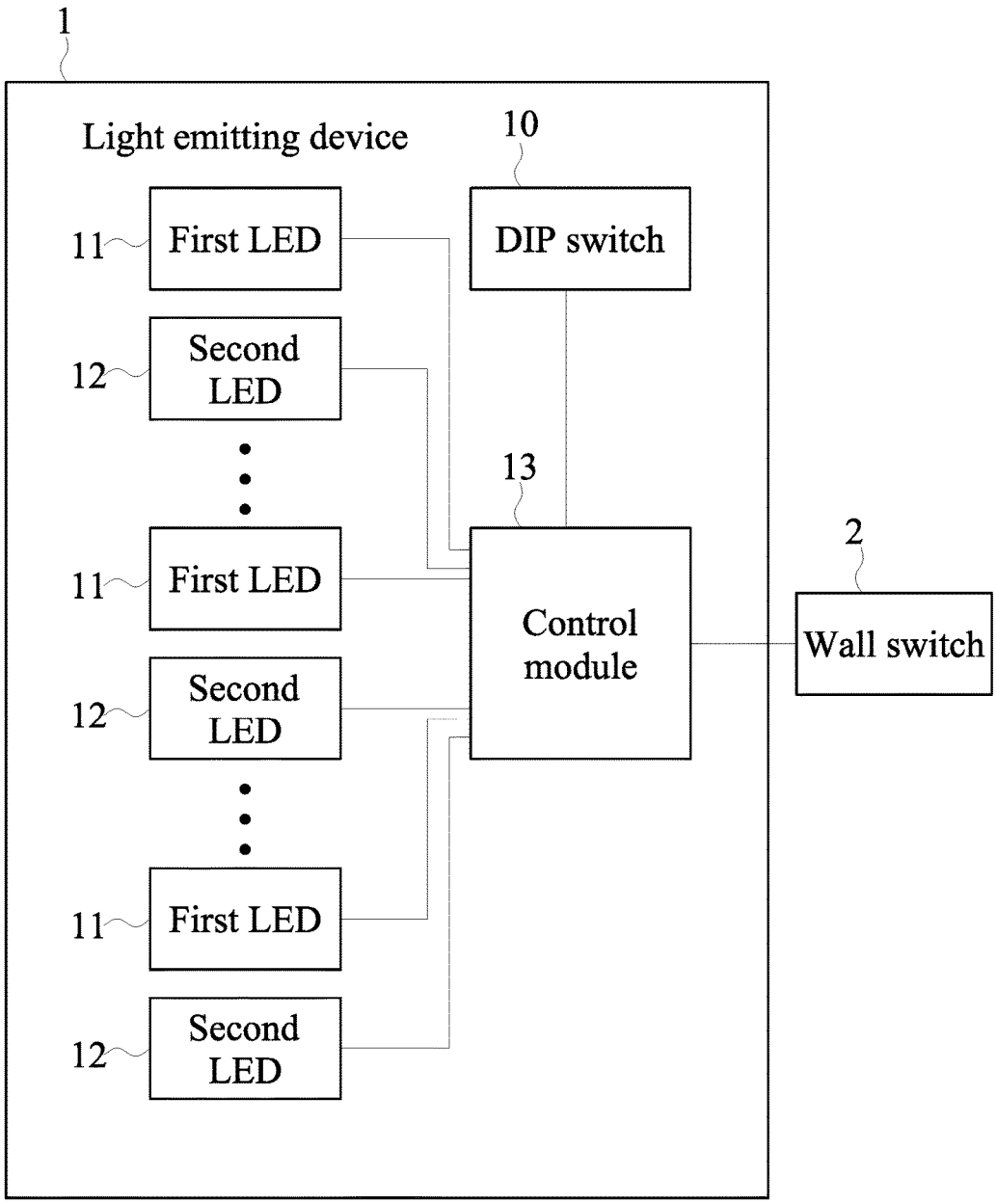
FIG. 1 is a schematic block diagram of a light-emitting device in accordance with a first embodiment of the present invention.
Figure 2:
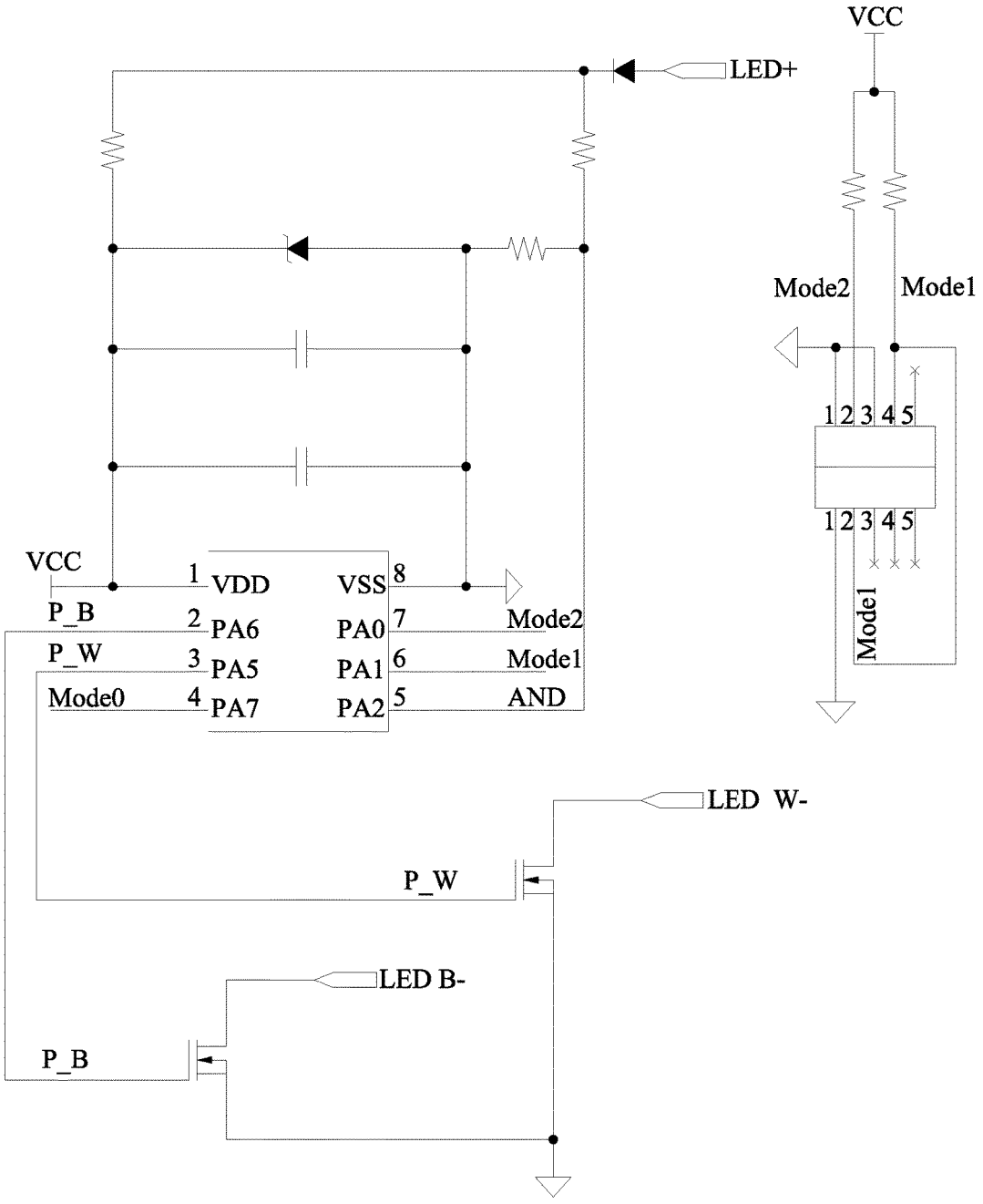
FIG. 2 is a schematic circuit diagram of a control module in accordance with the first embodiment of the present invention.
Figure 3:
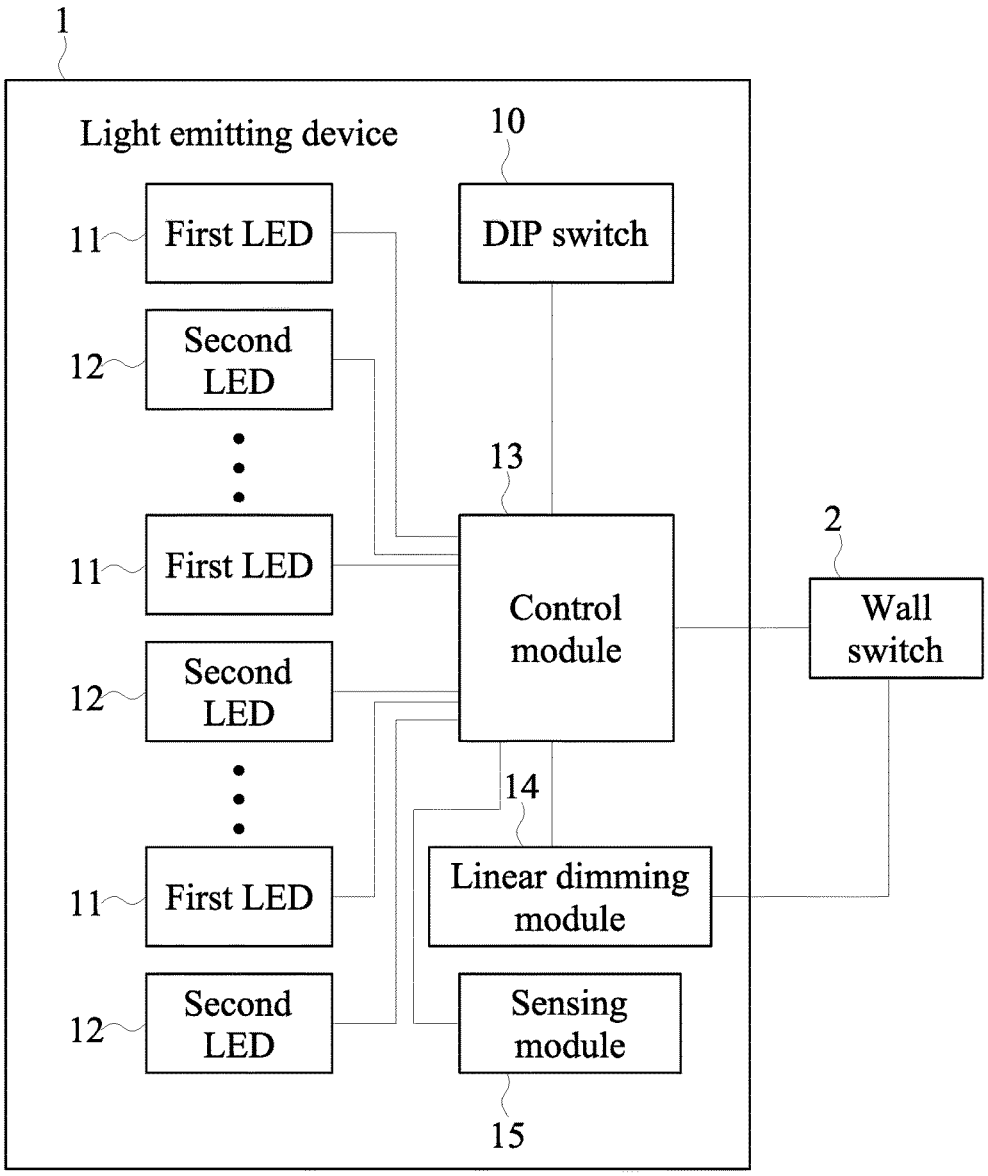
FIG. 3 is a schematic block diagram of a light-emitting device in accordance with another implementation mode of the first embodiment of the present invention.

With reference to FIGS. 1 to 3 for a schematic block diagram of a light-emitting device, a schematic circuit diagram of a control module, and a schematic block diagram of another implementation mode of the light-emitting device in accordance with the first embodiment of the present invention respectively, the light-emitting device with digital control of color temperature modulation 1 is electrically coupled to a wall switch 2 for controlling an ON or OFF state, and the light-emitting device 1 comprises a DIP switch 10, a plurality of first LEDs 11, a plurality of second LEDs 12, and a control module 13.

The first LEDs 11 have a first color temperature, and the second LEDs 12 have a second color temperature. The control module 13 is electrically coupled to the wall switch 2, the DIP switch 10, the first LEDs 11 and the second LEDs 12, wherein a truth table information is written into the control module 13, and the truth table information comprises a first mode, a second mode, a third mode and a memory and automatic switch mode, and digital switching is accomplished by correlating the DIP switch 10 to the truth table. Wherein, only the first LEDs 11 are turned on under a fixed power in the first mode; both of the first LEDs 11 and the second LEDs 12 are turned on under a fixed power in the second mode; and the second LEDs 12 are turned on under a fixed power in the third mode, so that the light-emitting device 1 has different expressions of color temperature. In the memory and automatic switch mode, the color temperatures of the first mode, the second mode and the third mode can be sequentially switched and controlled by turning on or off the wall switch 2 according to the truth table information. Switching and expressing the color temperature by the digital method can achieve the effects of improving the stability of the color temperature modulation, lowering the cost required for installing the product, and extending the overall service life effectively.

It is noteworthy that the present invention is different from the prior art. The light-emitting device 1 of the invention adopts a digital signal control method to adjust its light emitting status, so that the circuit of the light-emitting device 1 can be maintained in a connected status without having any disconnection or short circuit that requires a reconnection. The invention can improve the stability of switching the color temperature and the service life of the light-emitting device 1. in addition to the digital switching of the color temperature, the light-emitting device 1 also uses the digital method to control the light emitting status such as the brightness of each of the first LEDs 11 and each of the seconds LED 12 or the status whether or not these LEDs are driven, so as to express the required color temperature. With this digital control method, the light-emitting device 1 just needs a small quantity of LEDs to express diversified color temperatures, without the need of installing LED strings for different color temperatures. Therefore, the invention can lower the required setup cost significantly, particularly when the first LEDs 11 and the second LEDs 12 in the second mode are turned on, and the method of controlling each of the first LEDs 11 and each of the second LEDs 12 by the digital control method can mix lights to produce different required color temperatures. The light-emitting device 1 of the present invention requiring no analog mechanical switch to connect or disconnect each circuit contact in order to achieve the effect of modulating the color temperature, so that the invention can adjust the expression and switching of the color temperature of the light-emitting device 1 accurately and stably and avoid worn-outs, poor contacts, or even electric arcs of the hardware circuits caused by switching the switch and connecting or disconnecting each circuit contact. The invention is capable of controlling the color temperature effectively and providing a stable and excellent color temperature modulation method.

The truth table information is set as shown in the following table. With reference FIG. 2 for the schematic circuit diagram of a control module in accordance with a preferred embodiment of the present invention, the modes of the signals of the control module 13 are shown in the table.

Truth Table Information

| | Mode2 (PA0, PIN7) | Mode1 (PA1, PIN6) | P_B (PA6, PIN2) | P_W (PA5, PIN3) |
|---|---|---|---|---|
| First mode | 0 | 0 | 1 | 0 |
| Second mode | 0 | 1 | 1 | 1 |
| Third mode | 1 | 0 | 0 | 1 |
| Memory and automatic switch mode | 1 | 1 | X | X |

In an application, when the DIP switch 10 is switched to different modes of color temperature, the control module 13 performs a digital signal control according to the truth table information, so that the light-emitting device 1 can express a color temperature corresponding to the first mode, the second mode and the third mode. When the DIP switch 10 is switched to the memory and automatic switch mode, the first mode, the second mode and the third mode may be switched sequentially by turning on or off the wall switch 2 according to the truth table information, and a user may adjust the light-emitting device 1 to express the required color temperature by adjusting the wall switch 2.

In this embodiment, the control module 13 has a delay off mechanism. When the wall switch 2 is turned off, the timing asynchronously shows an electrically OFF state. When the wall switch 2 is turned on, a power divided voltage is read to detect the number of times of switching and provided for the memory and automatic switch mode to be saved as a mode of the previous truth table information. The wall switch 2 has a larger capacitance than the control module 13, so that when the wall switch 2 is turned off, the control module 13 will show an electrically OFF state after a certain period of time, and when the wall switch 2 is turned on again, the control module 13 reads a power divided voltage to detect the number of times of switching to facilitate saving the mode of the previous truth table information under the memory and automatic switch mode, and the ON and OFF state of the wall switch 2 are switched, so that the light-emitting device 1 can be switched sequentially to the first mode, the second mode and the third mode according to the sequence of the truth table information.

In this embodiment, the first color temperature is 3000K, and the second color temperature is 5000K. In the first mode, the color temperature of 3000K may be expressed. In the third mode, the color temperature of 5000K may be expressed. Therefore, the light-emitting device 1 has a better color temperature modulation range to improve the expression of color temperature of the light-emitting device 1 in the second mode. For example, when the second mode is driven, the light-emitting device 1 expresses a color temperature of 3500K, 4000K or 4500K by a digital controlled light mixing method. Preferably, the first LEDs 11 and the second LEDs 12 are arranged alternately to optimize the light emitting expression of the light-emitting device 1.

To enhance the function of the light-emitting device 1, the light-emitting device 1 as shown in FIG. 3 further comprises a linear dimming module 14 electrically coupled to the control module 13 and the wall switch 2 for linearly adjusting the output of the fixed power, so that the brightness of the light-emitting device 1 can be changed linearly by the output of the fixed power to facilitate users to adjust the brightness of the light-emitting device 1 as needed.

In addition, the light-emitting device 1 further comprises a sensing module 15 electrically coupled to the control module 13 for detecting an ambient color temperature. In the second mode, the light emission ratio and mode of the first LEDs 11 and the second LEDs 12 are adjusted according to the ambient color temperature. When the light-emitting device 1 is adjusted to the second mode, the first LEDs 11 and the second LEDs 12 are turned on simultaneously, so that the expression of color temperature can be changed by mixing the first LEDs 11 and the second LEDs 12. Now, the control module 13 can automatically adjust the color temperature of the light-emitting device 1 in the second mode according to the ambient color temperature detected by the sensing module 15. For example, a user may need the expression of a different color temperature at different time points or in different applications. Now, the ambient color temperature of the current environment is detected by the sensing module 15, and then the control module 13 automatically adjusts the light emission ratio and mode of the first LEDs 11 and the second LEDs 12 when the light-emitting device 1 is situated at the second mode to timely modulate the color temperature of the second mode and provide a better lighting feel. When it is applied in an exhibition environment, the light intensity can be changed automatically according to different time points of the environment to provide the best exhibition of showpieces to viewers.

Figure 4:
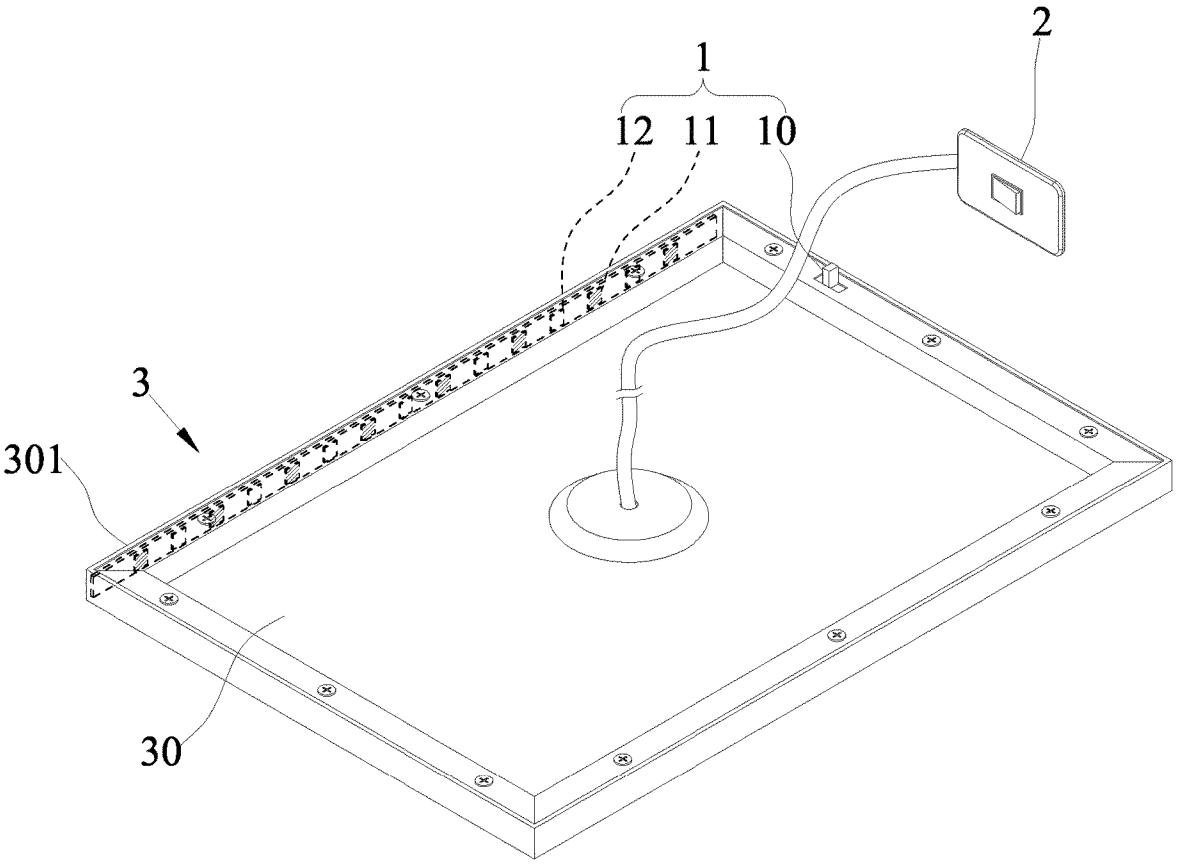
FIG. 4 is a schematic view of a light fixture in accordance with a second embodiment of the present invention.

Based on the product designed by the digital control and the concept of switching color temperatures, the light-emitting device 1 of the present invention has a wide range of application. The product applying the light-emitting device 1 of the present invention can improve the drawbacks of the product, so as to enhance the convenience of use of the light-emitting device 1. With reference to FIG. 4 for a schematic view of a light fixture in accordance with the second embodiment of the present invention as well as FIGS. 1 to 3, the content described in the first embodiment and the technical characteristics of this embodiment identical to those described above will not be repeated. It is noteworthy that same elements are presented by same respective numerals. The present invention provides a light fixture 3 comprising a main body 30 and a light-emitting device with digital control of color temperature modulation 1 as described in the first embodiment. The main body 30 has a mount 301, and the light-emitting device 1 is installed to the mount 301 for providing light. The light fixture 3 with the light-emitting device 1 can be adjusted by a digital control method to express the color temperature, so as to comply with the lighting condition required by the user or environment. The invention provides a light fixture 3 with a multi-color temperature modulation and controls the color temperature according to a user's preference. The expression of color temperature, the operation method and the corresponding effect of the light-emitting device 1 have been described in the first embodiment and thus will not be repeated. Preferably, the light fixture 3 is a panel light, a down light or a bulb light, and the connection between the light fixture 3 and the wall switch 2 as shown in the figure is just provided for the purpose of illustration and not intended for limiting the scope of the invention to a particular product.

In this embodiment, the control module 13 of the light-emitting device 1 further has a delay off mechanism provided for the memory and automatic switch mode to be saved as a mode of the previous truth table information. Wherein, the first color temperature is 3000K, and the second color temperature is 5000K, and the first LEDs 11 and the second LEDs 12 are arranged alternately. In addition, the light-emitting device 1 further includes the linear dimming module 14 and the sensing module 15, and the linear dimming module 14 is provided for linearly adjusting the output of the fixed power, so as to change the brightness of the light-emitting device 1 and the light fixture, and the sensing module 15 is provided for detecting a ambient color temperature to facilitate the adjustment of the light emission ratio and mode of the first LEDs 11 and the second LEDs 12 in the second mode according to the ambient color temperature. The detailed technical characteristics have been described above, and thus will not be repeated.

Figure 5:
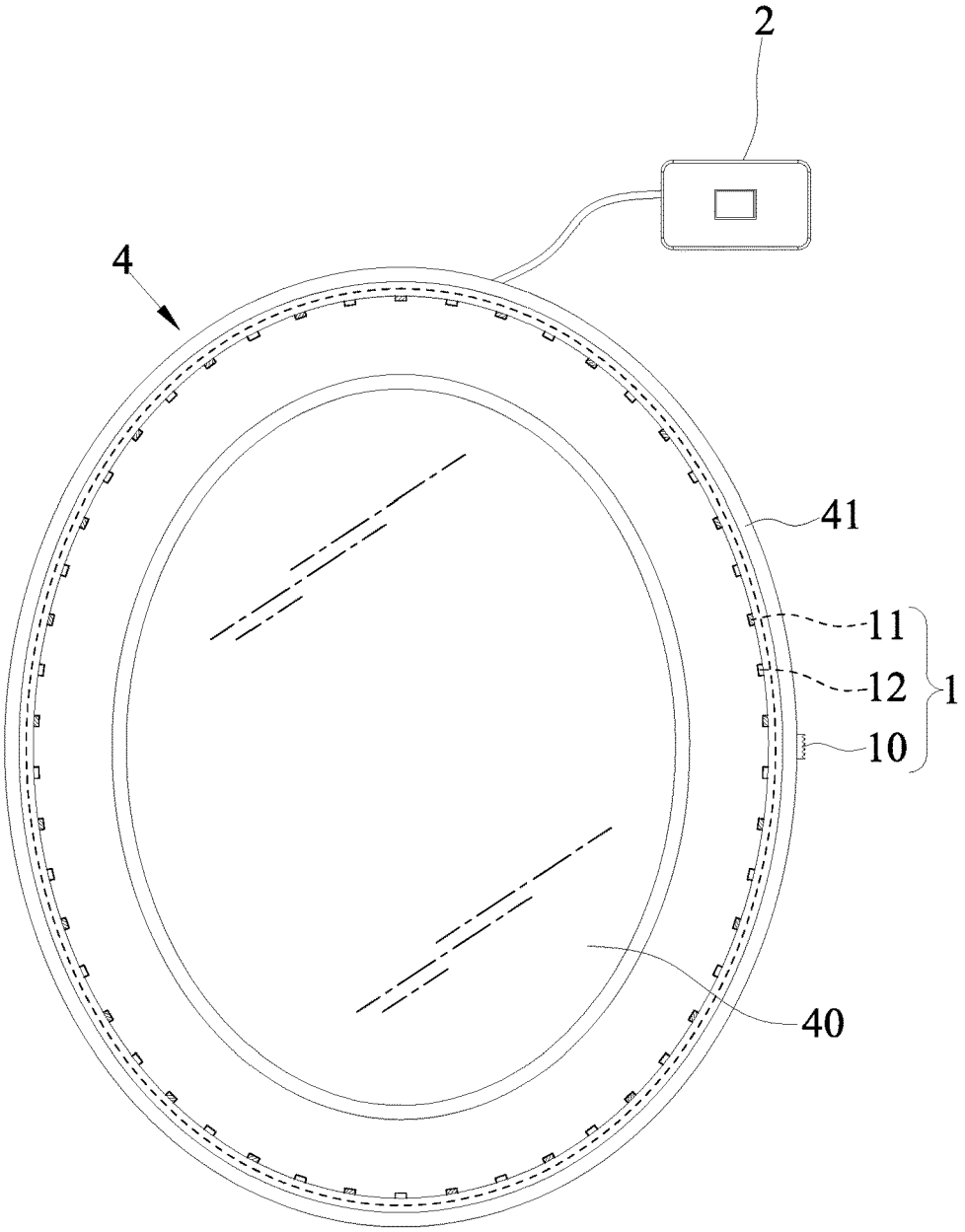
FIG. 5 is a schematic view of a mirror in accordance with the second embodiment of the present invention.

With reference to FIG. 5 for a schematic view of a mirror in accordance with the third embodiment of the present invention and FIGS. 1 to 3, the technical content and characteristics of this embodiment same as the first embodiment will not be repeated, and same elements are represented by same respective numerals. To improve the convenience of use of the daily products, the present invention discloses this embodiment and provides a mirror 4 with a light emitting effect comprising a mirror body 40, a fixed frame 41 and a light-emitting device with digital control of color temperature modulation 1 as described in the first embodiment. The fixed frame 41 is provided for fixing the mirror body 40, and the light-emitting device 1 is installed to the fixed frame 41 for providing light. When the light-emitting device 1 is combined and applied to the mirror, the mirror 4 performs a correction of the white balance in advance to express the color temperature for the subsequent environment correctly and precisely, so as to facilitate users to comb their hair. When a user uses the mirror 4 for grooming or combing, the light-emitting device 1 modulates the color temperature for performing a white balance correction. For example, the light-emitting device 1 is adjusted to a color temperature corresponding to a subsequent environment for light before combing the hair, so as to achieve the effect of the white balance correction. In the mirror 4 with the light emitting effect of this embodiment, the lighting effect is not just added, but the color temperature modulation is also provided for the white balance correction while the color temperature is switched and mixed by a digital control method. The color temperature expression, operation method, and corresponding effect of the light-emitting device 1 have been described in the first embodiment and will not be repeated.

In this embodiment, the control module 13 of the light-emitting device 1 further has the delay off mechanism provided for the memory and automatic switch mode to be saved as a mode of the previous truth table information, wherein the first color temperature is 3000K, the second color temperature is 5000K, and the first LEDs 11 and the second LEDs 12 are arranged alternately. In addition, the light-emitting device 1 further comprises the linear dimming module 14 and the sensing module 15, and the linear dimming module 14 is provided for linearly adjusting the output of the fixed power to change the brightness of the mirror 4 with the light-emitting device 1, and the sensing module 15 is provided for detecting the ambient color temperature to facilitate adjusting the light emission ratio and mode of the first LEDs 11 and the second LEDs 12 in the second mode according to the ambient color temperature. The detailed operation and technical characteristics have been described above, and thus will not be repeated.

In summation of the description above, the present invention discloses a light-emitting device with digital control of color temperature modulation and its application and combines the truth table information with the DIP switch and the wall switch to achieve the digital switching control of the color temperature and effectively avoid the mechanism of changing a color temperature by an analog control, and prevent short circuit or disconnection caused by switching the switch and overcome the drawback of wearing out the components easily by the repeated connection and disconnection. The invention achieves the effects of providing a stable multi-color temperature expression, reducing the setup cost significantly and extending the service life of the light-emitting device. With the linear dimming module and the sensing module, the invention can output light for the required performance of the light-emitting device to meet different requirements. In addition, the light-emitting device may be applied to a light fixture or a mirror to provide a light source, and the invention can enhance the function of the light fixture or mirror.

What is claimed is:

1. A light-emitting device with digital control of color temperature modulation, electrically coupled to a wall switch for controlling an ON or OFF state, comprising:

a DIP switch;

a plurality of first LEDs, having a first color temperature;

a plurality of second LEDs, having a second color temperature; and a control module, electrically coupled to the wall switch, the DIP switch, the plurality of first LEDs, and the plurality of second LEDs, wherein a truth table information is written into the control module, and the truth table information includes a first mode, a second mode, a third mode, and a memory and automatic switch mode, and the DIP switch is set to perform a digital switching for selectively activating said first, second, third, and memory and automatic switch modes according to the truth table information, and only the plurality of first LEDs are turned ON under a fixed power in the first mode; both of the plurality of first LEDs and the plurality of second LEDs are turned ON simultaneously under the fixed power in the second mode; only the plurality of second LEDs are turned on under the fixed power in the third mode; and in the memory and automatic switch mode, a color temperature is sequentially switched and controlled by an operation of turning on and off of the wall switch according to the truth table information which is the first mode, the second mode and the third mode, wherein, the wall switch has a larger capacitance than the control module so that when the wall switch is turned off, the control module remain in a turn on state for a period of time, wherein, when the wall switch is turned on, the control module detects a number of times of switching when the wall switch is situated at an ON operation, the number of times of switching is provided for the memory and automatic switch mode to be saved as mode of a previous truth table information.

2. The light-emitting device of claim 1, further comprising a linear dimming module electrically coupled to the control module and the wall switch for linearly adjusting an output of the fixed power.

3. The light-emitting device according to claim 2, wherein the first color temperature is 3000K, and the second color temperature is 5000K.

4. The light-emitting device of claim 3, wherein the plurality of first LEDs and the plurality of second LEDs are alternately arranged.

5. The light-emitting device of claim 4, further comprising a sensing module, electrically coupled to the control module for detecting an ambient color temperature, and a light emission ratio and mode of the plurality of first LEDs and the plurality of second LEDs being adjusted according to the ambient color temperature when the plurality of first LEDs and the plurality of second LEDs are situated at the second mode.

6. A light fixture, comprising:

a main body, having a mount; and a light-emitting device as claimed in claim 2, installed to the mount, for providing light.

7. The light fixture of claim 6, wherein the light fixture is a panel light, a down light or a bulb light.

8. The light-emitting device according to claim 1, wherein the first color temperature is 3000K, and the second color temperature is 5000K.

9. The light-emitting device of claim 8, wherein the plurality of first LEDs and the plurality of second LEDs are alternately arranged.

10. The light-emitting device of claim 9, further comprising a sensing module, electrically coupled to the control module for detecting an ambient color temperature, and a light emission ratio and mode of the plurality of first LEDs and the plurality of second LEDs being adjusted according to the ambient color temperature when the plurality of first LEDs and the plurality of second LEDs are situated at the second mode.

11. The light-emitting device according to claim 1, wherein the first color temperature is 3000K, and the second color temperature is 5000K.

12. The light-emitting device of claim 11, wherein the plurality of first LEDs and the plurality of second LEDs are alternately arranged.

13. The light-emitting device of claim 12, further comprising a sensing module, electrically coupled to the control module for detecting an ambient color temperature, and a light emission ratio and mode of the plurality of first LEDs and the plurality of second LEDs being adjusted according to the ambient color temperature when the plurality of first LEDs and the plurality of second LEDs are situated at the second mode.

14. A light fixture, comprising:

a main body, having a mount; and a light-emitting device as claimed in claim 1, installed to the mount, for providing light.

15. The light fixture of claim 14, wherein the light fixture is a panel light, a down light or a bulb light.

16. A light fixture, comprising:

a main body, having a mount; and a light-emitting device as claimed in claim 1, installed to the mount, for providing light.

17. The light fixture of claim 16, wherein the light fixture is a panel light, a down light or a bulb light.

18. A mirror with a light emitting effect, comprising:

a mirror body;

a fixed frame, for fixing the mirror body; and a light-emitting device as claimed in claim 1, installed to the fixed frame, for providing light.

* * * * *